US005258819A

United States Patent [19]

Kimura et al.

[11] Patent Number: 5,258,819

[45] Date of Patent: Nov. 2, 1993

[54] IMAGE FORMING APPARATUS HAVING A REVOLVER TYPE DEVELOPING DEVICE

[75] Inventors: Noriyuki Kimura, Kawasaki; Minoru Suzuki, Yokohama, both of Japan

[73] Assignee: Richo Company, Ltd., Tokyo, Japan

[21] Appl. No.: 14,556

[22] Filed: Feb. 8, 1993

[30] Foreign Application Priority Data

Feb. 27, 1992 [JP] Japan ..... 4-41081

[51] Int. Cl.[5] ..... G03G 15/01

[52] U.S. Cl. ..... 355/326 R; 355/245

[58] Field of Search ..... 355/327, 326, 245, 212; 118/645

[56] References Cited

U.S. PATENT DOCUMENTS

| | | | |
|---|---|---|---|
| 4,622,916 | 11/1986 | Tanaka et al. | 118/645 X |
| 4,713,673 | 12/1987 | Kessoku . | |
| 4,728,987 | 3/1988 | Diola et al. . | |
| 4,922,301 | 5/1990 | Katoh et al. | 355/326 X |
| 4,933,727 | 6/1990 | Mizuma et al. | 355/327 |
| 4,939,548 | 7/1990 | Yamada et al. | 355/326 X |
| 5,040,031 | 8/1991 | Hayashi | 355/326 |
| 5,160,969 | 11/1992 | Mizuma et al. | 355/326 |
| 5,162,859 | 11/1992 | Hirono et al. | 355/327 X |
| 5,168,319 | 12/1992 | Kimura et al. | 355/326 |
| 5,198,866 | 3/1993 | Kimura et al. | 355/326 |

*Primary Examiner*—R. L. Moses

*Attorney, Agent, or Firm*—Oblon, Spivak, McClelland, Maier & Neustadt

[57] ABSTRACT

An image forming apparatus having an image carrier for electrostatically forming a latent image thereon, and a revolver type developing device located in close proximity to the image carrier and having a plurality of developing units each containing a powdery developer of particular color arranged around a rotary shaft, and rotating the developing device to selectively locate one of the developing units at a developing position where the developing unit faces the image carrier for developing the latent image. A guide member is mounted on a body of the apparatus and formed with an engaging portion for guiding the developing device toward and away from the image carrier in engagement with the rotary shaft. A movable member holds the developing device in such a manner as to allow it to be mounted and dismounted in the up-and-down direction and causes the device to move along the guide member.

8 Claims, 12 Drawing Sheets

IMAGE FORMING APPARATUS HAVING A REVOLVER TYPE DEVELOPING DEVICE

BACKGROUND OF THE INVENTION

The present invention relates to an image forming apparatus of the type using a revolver type developing device having a plurality of developing units therein.

Conventional image forming apparatuses include a full-color copier which exposes a photoconductive element or similar image carrier to color-separated light images to electrostatically form corresponding latent images, develops each of the latent images by a toner of complementary color, and transfers the resulting toner images to a single recording medium one above the other. A multicolor image forming apparatus is also conventional which sequentially exposes an image carrier to images to be reproduced in different colors, develops each of the resulting images by a developer of particular color to produce a corresponding toner image, and transfers such toner images to a single recording medium. This kind of image forming apparatuses need a plurality of developing units. However, a plurality of developing units constructed independently of each other and arranged around the image carrier would increase the overall size of the apparatus. A revolver type or rotary type developing device which is a recent achievement can eliminate this problem. The revolver type developing device, or simply revolver as referred to hereinafter, has a rotatable cylindrical casing located to face an image carrier, and a plurality of developing units disposed in the casing and supported in predetermined positions. The developing units are sequentially brought to a developing position to develop latent images by respective toners.

Regarding a copier, for example, monocolor documents, particularly black-and-white documents, are predominant over the other documents as far as daily office work is concerned. Hence, a toner of particular color, especially a black toner, is consumed in a particularly great amount. In the case of the revolver, the amount of toner which each developing unit can store is limited. In addition, it is difficult to connect large capacity toner containers to the outside of the revolver since the revolver bodily rotates. Moreover, supplementing the toner consumed in a particularly great amount from the outside of the device is inconvenient. In the light of this, Japanese Patent Laid-Open Publication No. 71981/1987, for example, proposes a copier which is usually loaded with a monocolor, e.g., black developing device for ordinary copy work and allows such a developing device to be replaced with a revolver type developing device for color copies, as needed. While this proposal pertains to two colors or so-called multicolor, e.g., red and blue, the above principle is also true with a greater number of colors or with a full-color developing device storing yellow, magenta and cyan toners.

Due to the spread of copiers and other image forming apparatuses, a current trend is toward an arrangement which allows the user to replace or otherwise manipulate individual units or an image forming device incorporating a plurality of units. Then, easy and safe replacement of the units and device and easy handling of substitute units and device are important considerations.

To load and unload the revolver with the units, the units may each be mounted on the front or the top of the apparatus body independently of the others, as disclosed in, for example, Japanese Patent Laid-Open Publication Nos. 208779/1985 and 127850/1987. However, the problem with this kind of scheme is that since the units are handled independently of each other, the replacement of the units for selectively dealing with black-and-white images or color images as stated above is not easy although the scheme may facilitate the replacement of the individual units and maintenance.

A developing device having a plurality of developing units constructed integrally with each other is taught in Japanese Patent Laid-Open Publication No. 78170/1988 by way of example. This kind of device allows all the developing units to be replaced by a single operation. However, since the units have to be pulled out at the front of the apparatus body, an extra mechanism for moving the units away from a photoconductive element before mounting or dismounting is needed. Further, to fully mount and dismount the units, slide rails and guides for facilitating the movement of the units in the longitudinal direction thereof are indispensable. As a result, there have to be provided a mechanism for promoting smooth mounting and dismounting work, and a rigid and reliable mechanism for protecting the units from damage due to a fall, preventing the toners from contaminating the surrounding and operator, and protecting the operator from injury. Such mechanisms are complicated and expensive, increasing the cost of the apparatus body. Moreover, the units cannot be pulled out at the front of the apparatus body unless the front side wall of the apparatus body is formed with an opening greater than the diameter of the units. The opening reduces the strength of the side wall and, therefore, makes it impossible to reduce the thickness of the side wall or requires some reinforcement. In addition, the opening has to be provided with a mechanism or member for positioning the units relative to the photoconductive element, further increasing the cost and complicating the mounting and dismounting work.

When the individual units or the revolver having any one of the above-described configurations is removed from the apparatus body, left at the outside of the apparatus body or transported, it is likely that the toner deposited on the casing and in the vicinity of the opening is scattered around to the outside. Further, a developer carrier is apt to appear via the opening of the casing to be damaged. Moreover, when the revolver is left at the outside of the apparatus or transported to another location, dust particles and other impurities are apt to enter the revolver via the opening of the casing. Such impurities would not only disturb images but also damage the constituent parts of the revolver.

As stated above, all the conventional schemes have defects regarding, among others, the replacement of the revolver. Specifically, with such schemes, it is difficult to replace or mount and dismount the units and position them in the event of mounting.

SUMMARY OF THE INVENTION

It is, therefore, an object of the present invention to provide an image forming apparatus having a revolver type developing device which can be surely and easily replaced and positioned.

In accordance with the present invention, an image forming apparatus of the type having an image carrier for electrostatically forming a latent image thereon, and a revolver type developing device located in close proximity to the image carrier and having a plurality of developing units each containing a powdery developer of particular color arranged around a rotary shaft, and rotating the developing device to selectively locate one of the developing units at a developing position where the developing unit faces the image carrier for developing the latent image comprises a guide member mounted on a body of the apparatus and formed with an engaging portion for guiding the developing device toward and away from the image carrier in engagement with the rotary shaft, and a movable member for holding the developing device in such a manner as to allow it to be mounted and dismounted in the up-and-down direction and causing the device to move along the guide member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 2:
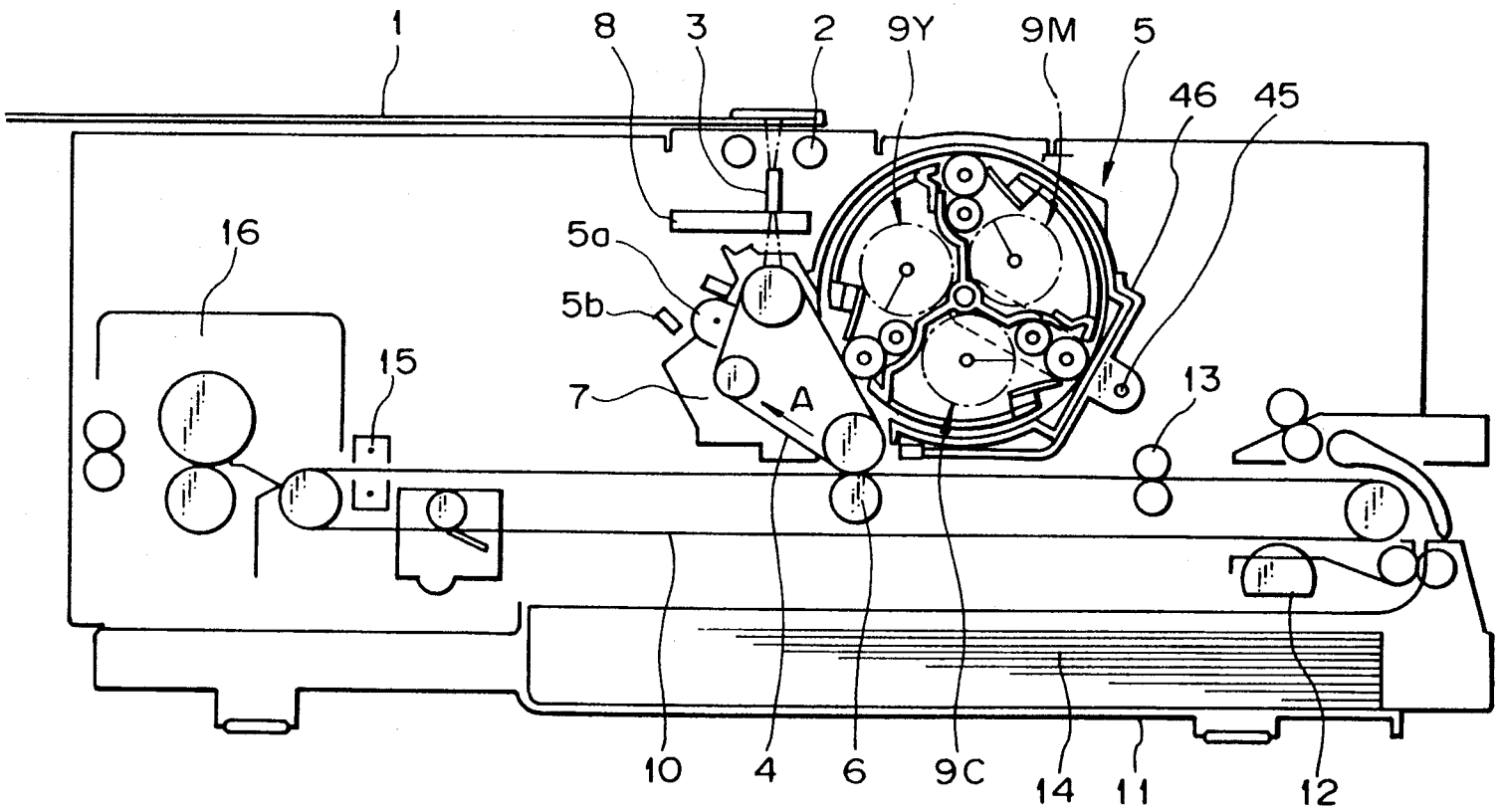
FIG. 2 is a front view of a full-color copier which is a specific form of the image forming apparatus in accordance with the present invention.

Referring to FIG. 2 of the drawings, an image forming apparatus embodying the present invention is shown and implemented as a full-color copier by way of example. As shown, the copier has a glass platen 1 movable in the right-and-left direction as viewed in the figure. As the glass platen 1 is moved, a document laid on the glass platen 1 is illuminated by a lamp 2 through a slit at a predetermined position. The resulting reflection from the document is focused onto a photoconductive element, or image carrier, 4 via a rod lens array 3. In the embodiment, the photoconductive element 4 is implemented as a belt. At this instant, a subscan drive mechanism, not shown, moves the glass platen 1 and belt 4 in synchronism. Consequently, a latent image is electrostatically formed on the belt 4 having been uniformly charged by a charger 5*a*. A revolver type developing device, or simply revolver as often referred to hereinafter, 5, a transfer roller 6, a cleaning device 7 and a discharge lamp 5*b* are sequentially arranged around the belt 4 in a direction indicated by an arrow in the figure. Filters 8 of three primary colors, i.e., blue, green and red are selectively located on the optical path for exposure. The latent images formed via the filters 8 are respectively developed by yellow, magenta and cyan developing units $9_Y$, $9_M$ and $9_C$ built in the revolver 5.

A transport belt 10 is disposed in an image transfer section and surrounds the transfer roller 6. A recording medium, e.g., a paper 14 is fed from a tray 11 by a pick-up roller 12 and driven to the belt 10 via a register roller 13. The belt 10 transports the paper 14 in a reciprocating motion in the horizontal direction while positively retaining it thereon. As a result, the toner images of three different colors are sequentially transferred to the paper 14 one above the other. The paper 14 carrying the resulting full-color image thereon is discharged by a discharger 15 together with the belt 10 to be thereby separated from the belt 10. After the image has been fixed on the paper 14 by a fixing device 16, the paper 14 is driven out of the copier as a full-color copy.

Figure 3:
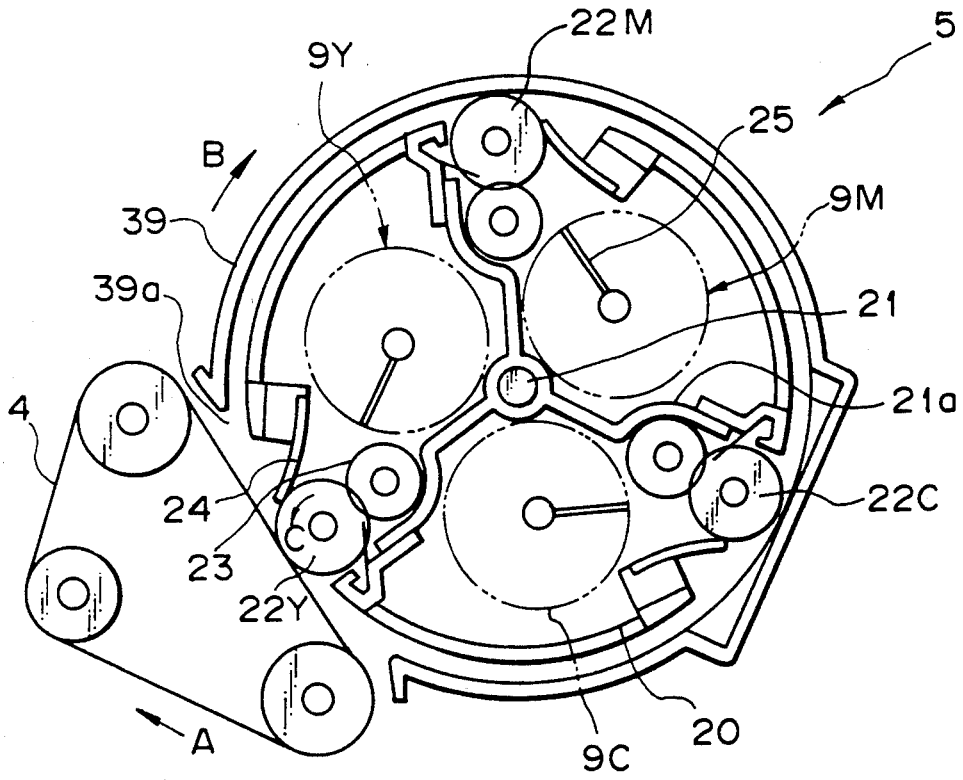
FIG. 3 is an enlarged front view of a developing device included in the copier of FIG. 2.

FIG. 3 shows the revolver type developing device 5 in detail. As shown, the revolver 5 has a hollow cylindrical casing 20 rotatable about a rotary shaft 21. A drive transmission mechanism which will be describes causes the casing 20 to rotate in a direction indicated by an arrow in the figure. Three partition plates 21*a* are disposed in the casing 20 and radially extend from the shaft 21. The previously mentioned developing units $9_Y$, $9_M$ and $9_C$ are defined by the partition plates 21*a*.

In the specific condition shown in FIG. 2, the developing unit $9_Y$ is located at a developing position where it faces the belt 4. The developing units $9_Y$, $9_M$ and $9_C$ incorporate cylindrical developing rollers, or developer transport members, $22_Y$, $22_M$ and $22_C$, respectively. The developing rollers $22_Y$–$22_C$ are each partly exposed to the outside via an associated opening formed through the casing 20. The rollers $22_Y$–$22_C$ are rotatable in a direction C when driven by a drive transmission mechanism which will be described.

In the illustrative embodiment, the developing units $9_Y$, $9_M$ and $9_C$ store nonmagnetic one component type developers, i.e., a yellow toner, a magenta toner, and a cyan toner, respectively. The developing units $9_Y$–$9_C$ are selectively rotated about the shaft 21 to the developing position to sequentially develop the latent images electrostatically formed on the belt 4. The resulting toner images of different colors are sequentially transferred to the paper 14 to form a composite full-color image.

A cylindrical toner supply roller 23 is pressed against each of the developing rollers 22 and made of foam polyurethane or similar elastic material. The supply roller 23 is rotated in a direction D by a drive transmission mechanism which will be described to supply the toner to the associated developing roller 22 while charging it by friction. A blade 24 is also made of urethane rubber or similar elastic material and located downstream of the supply roller 23 with respect to the direction of rotation of the developing roller 22. One edge of the blade 24 is pressed against the developing roller 22 to regulate the thickness of the toner deposited on the roller 22. Further. an agitator 25 is disposed in each of the developing units $9_Y$–$9_C$ and driven at an adequate timing by a drive mechanism, not shown.

Figure 4:
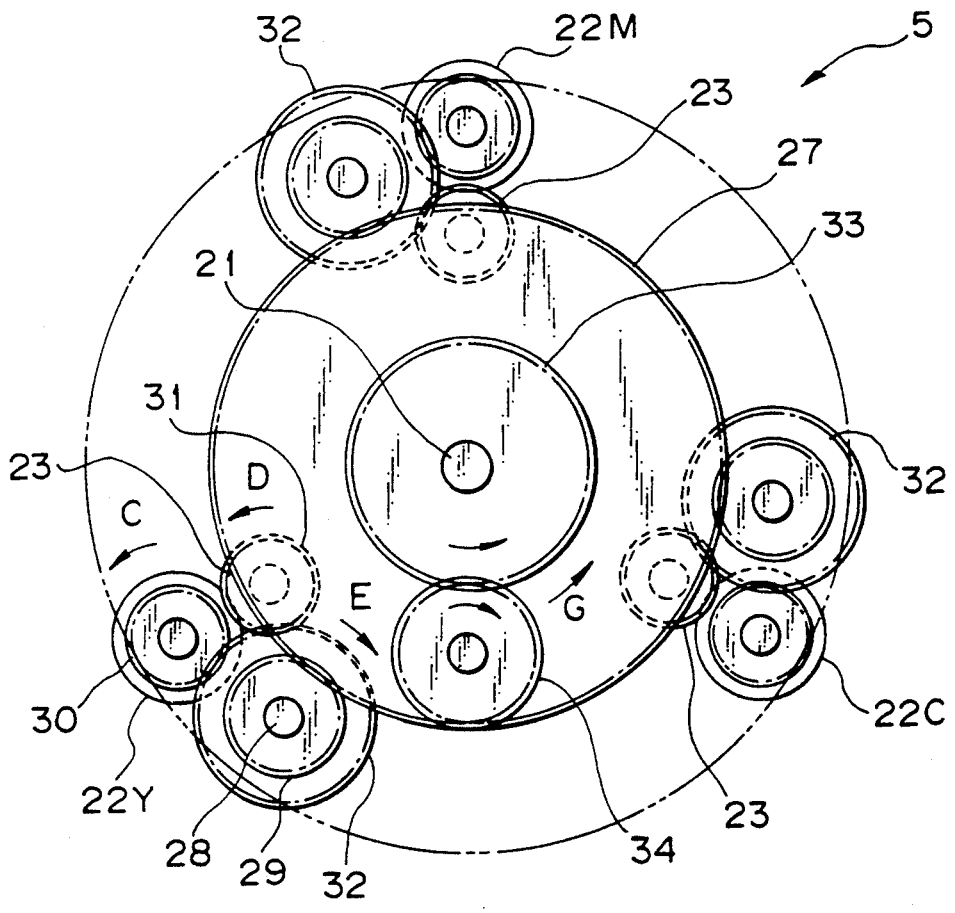
FIG. 4 is a front view showing a drive transmission system associated with the developing device.
Figure 5:
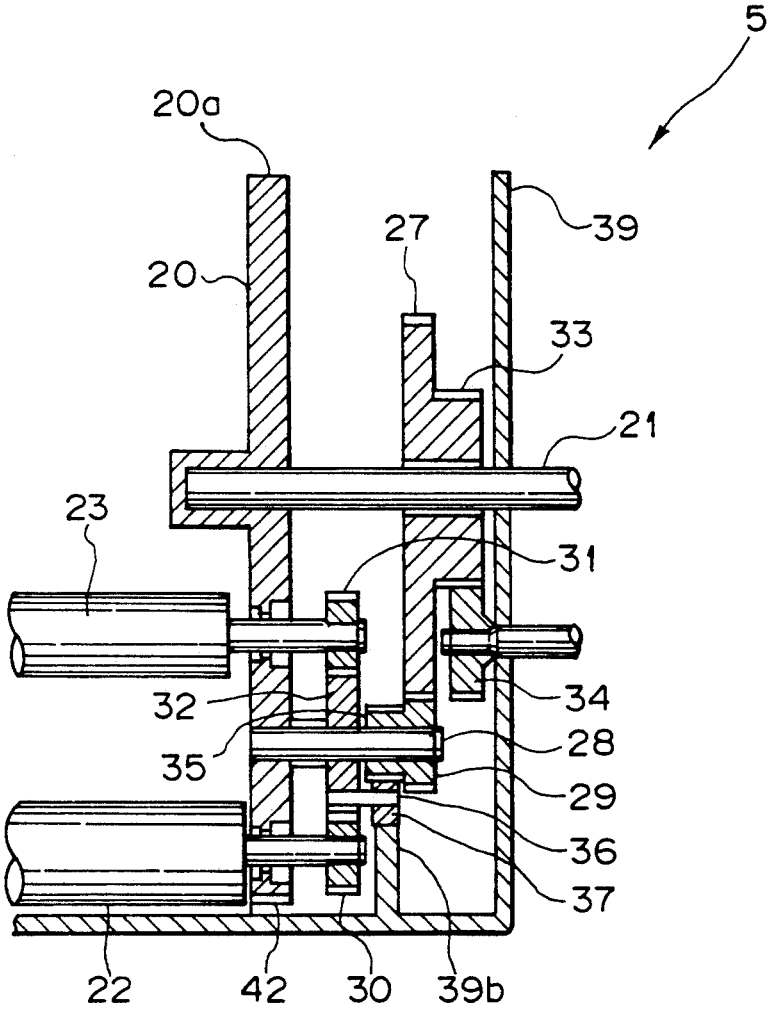
FIG. 5 is a fragmentary section of the drive transmission system.

A reference will be made to FIGS. 4, 5, 6A and 6B for describing a mechanism for driving the developing device 5. As shown in FIGS. 4 and 5, a sun gear 27 is mounted coaxially with the shaft 21 of the revolver 5 and rotatable relative to the shaft 21 and a side wall 20*a* which forms part of the casing 20. Shafts 28 are affixed to the side wall 20*a* in one-to-one correspondence with the developing units 9Y–9C. A planetary gear or idler gear 29 is rotatably mounted on the fixed shaft 28 and held in mesh with the sun gear 27. Gears 30 and 31 are respectively mounted on the shaft of the developing roller 22 and the shaft of the supply roller 23. A clutch gear 32 is rotatably mounted on the fixed shaft 28 and meshed with the gears 30 and 31.

A gear 33 having a comparatively small diameter is formed integrally with the sun gear 27 and meshed with a gear 34. While development is under way, the gear 34 is rotated by a drive source, not shown, mounted on the copier body to in turn rotate the sun gear 27 and idler gears 29 at a constant rate. A drum portion 35 is formed integrally with each idler gear 29 and provided with a ratchet teeth in the form of projections or recesses on the outer periphery thereof. A pin 36 is studded on each clutch gear 32 while a pawl 37 is rotatably supported by the pin 36. A torsion coil spring or similar biasing means, not shown, constantly biases the pawl 37 in a direction indicated by an arrow F in FIG. 6B.

Figure 6A:
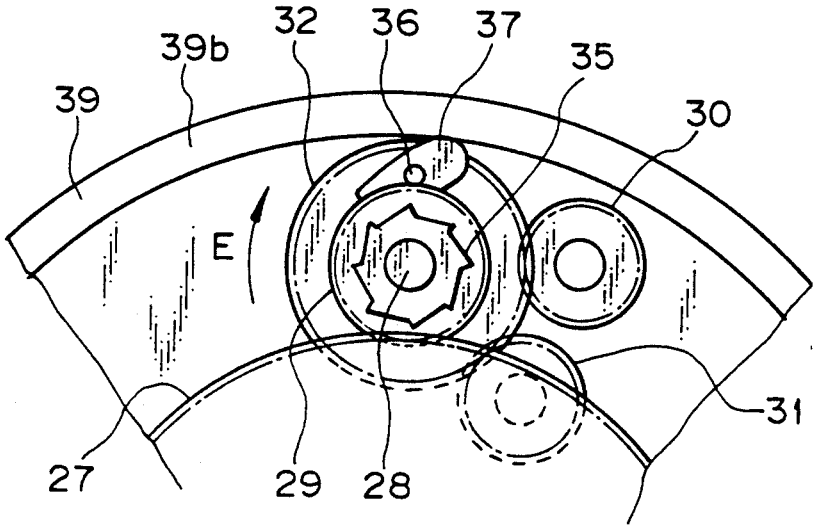
FIGS. 6A and 6B are front views showing the coupling and uncoupling operations of the drive transmission system.
Figure 6B:
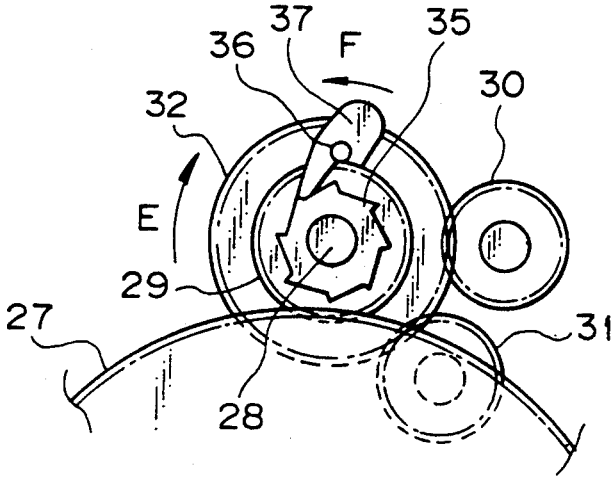
Figure 7:
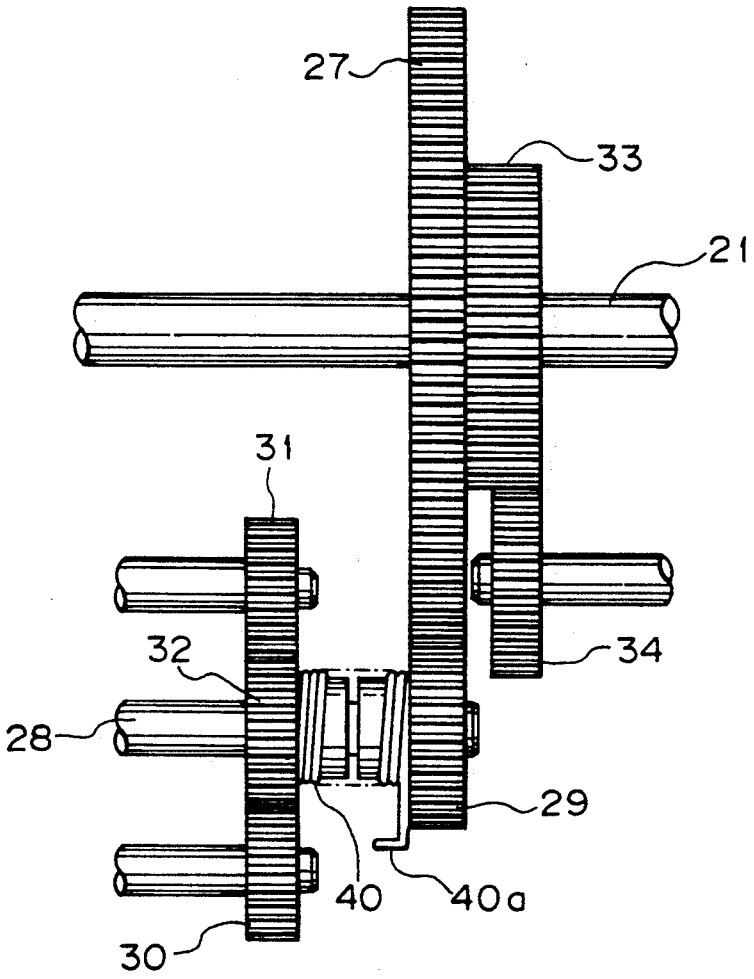
FIG. 7 is a side elevation showing a modified form of a clutch mechanism.
Figure 8:
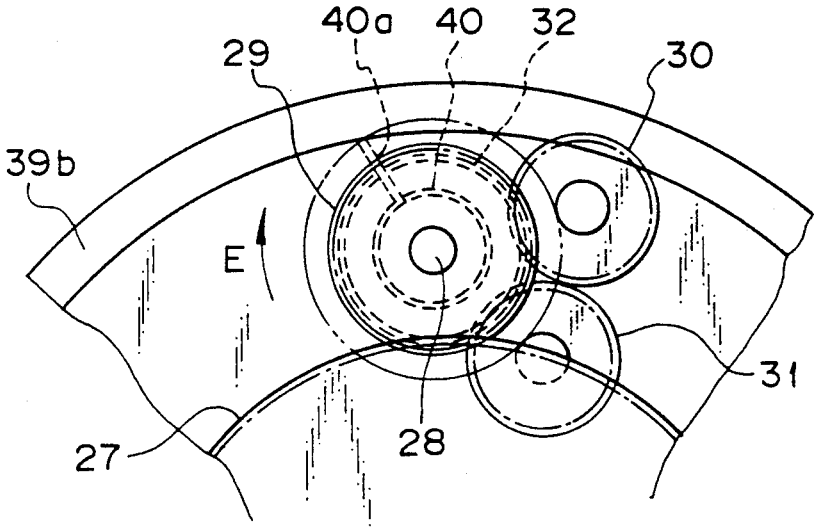
FIG. 8 is a front view demonstrating the coupling and uncoupling operations of the clutch mechanism of FIG. 7.
Figure 9A:
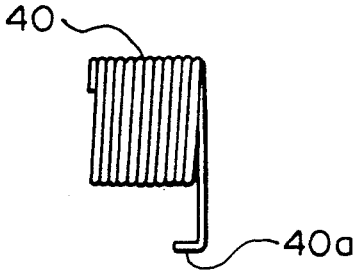
FIGS. 9A and 9B are views showing a coil spring.
Figure 9B:
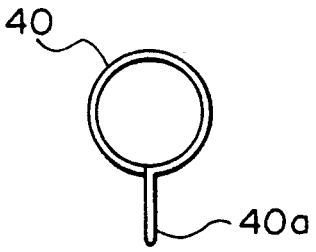

A cylindrical cover 39 covers the revolver 5 and has an opening 39*a*, FIG. 3, in part thereof. A projection 39*b* is provided on the inner periphery of the cover 39 to extend along the circumference of the cover 39. Assume that any one of the developing units $9_Y$–$9_C$ is located in a position other than the developing position. Then, the pawl 37 of the developing unit 9 is restrained by the projection 39*b* at the rear end thereof. Hence, as shown in FIG. 6A, a protuberance extending from the front end of the pawl 37 is spaced apart from the drum portion 35 of the idler gear 29. In this condition, a driving force is not transmitted to the clutch gear 32, i.e., to the developing roller 22 and supply roller 23. As the revolver 5 rotates to bring one of the developing units $9_Y$–$9_C$ to (or around) the developing position, the pawl 37 of the developing unit of interest is released from the projection 39*b* due to the opening 39*a* of the cover 39. As a result, the pawl 37 is rotated about the pin 36 in the direction F and brought into mesh with the ratchet teeth of the drum 35. The pawl 37, therefore, starts rotating in a direction E together with the idler gear 29. It follows that in the developing position the developing roller 22 and supply roller 23 are rotated to develop a latent image formed on the belt 4.

After such a sequence of image forming steps has been completed, the drive of the copier body for development is interrupted to stop the operation of the developing units $9_Y$–$9_C$.

FIGS. 7, 8, 9A and 9B show another specific clutch mechanism which is implemented as a so-called spring clutch mechanism. As shown, the idler gear 29 meshing with the sun gear 27 and the gear 32 meshing with the gears 30 and 31 are provided with drum portions which face each other. A torsion coil spring 40 is loaded between the drum portions of the gears 29 and 32. The coil spring 40 has an arm 40*a* at one end thereof. While development is not under way, the arm 40*a* is restrained by the projection 39*b* of the cover 39, as in the previous arrangement. This restraint acts in a direction for loosening the coil spring 40 with the result that the idler gear 29 simply idles. Hence, the driving force is not transmitted to the developing roller 22 and supply roller 23. As the associated developing unit 9 is brought to the developing position by the revolver 5, the arm 40*a* of the coil spring 40 is released from the projection 39*b* of the cover. Consequently, the rotation of the idler gear 29 is transferred to the developing roller 22 and supply roller 23 via the gear 32.

As stated above, the illustrative embodiment has a mechanical clutch structure capable of transmitting a driving force only in one direction. Hence, even when a force acts on, for example, the sun gear 27 in a direction opposite to expected one, it is not transferred to the developing roller 22. This prevents the toner from being scattered around and protects the developing unit from damage ascribable to the reverse rotation of the developing roller 22. It is to be noted that the clutch configurations described above are only illustrative and not limitative.

Further, in the embodiment, the member for restricting the drive transfer to the clutch is implemented as the circumferential projection 39*b* formed integrally with the cover 39. However, such a restricting member may alternatively be mounted on the side wall of the copier body, if necessary. In addition, the clutch mechanism may be directly mounted on the shaft of the developing roller 22 or that of the supply roller 23.

In the embodiment, the drive transfer is effected by the clutch mechanism while the gear associated with the clutch is held in mesh in a predetermined manner at all times. This is successful in eliminating incomplete mesh, vibration, noise and damage of the gear otherwise occurring on the replacement of the developing unit. Since the developing roller 22 is driven only at the predetermined developing position (and in close proximity thereto), the toner is prevented from being scattered around at the other positions. Moreover, since only one of the developing units is driven at a time, an excessive drive torque is not needed. In addition, the service life of the developing units is increased since they are free from loads when located at positions other than the developing position.

Furthermore, since the drive transfer is selectively effected by the mechanical clutch and since the developing device is loaded with a simple and reliable drive mechanism, the drive mechanism to be mounted on the copier body can be simplified and reduced in size without substantially increasing the size of the developing device. The drive mechanism does not rely on an electromagnetic clutch, solenoid or similar electric part. This kind of mechanism is inexpensive and resistive to noise.

The mechanical clutch transmits a driving force in only one direction, as stated earlier. Hence, even when a force acts on, for example, the sun gear 27 in a reserve direction due to a motor error or an externally derived force, it is not transmitted to the belt 4. This is also successful in preventing the toner from being scattered around and in protecting the developing unit from damage ascribable to the reverse rotation of the developing roller 22. The developing unit (developing roller) is constantly driven throughout the image forming operation (i.e. from the start to the end of printing) and, therefore, does not need any control in the event of replacement of the unit. In addition, since extra periods of time are not needed at the time of starting up and ending the developing roller drive, enhancing rapid image formation.

Figure 1A:
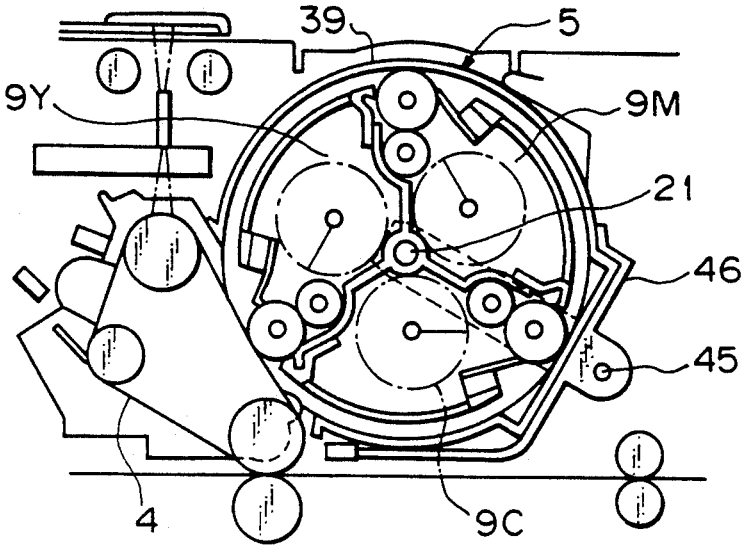
FIGS. 1A–1C are front views showing a sequence of steps for mounting and dismounting a revolver type developing device of an image forming apparatus embodying the present invention.
Figure 1B:
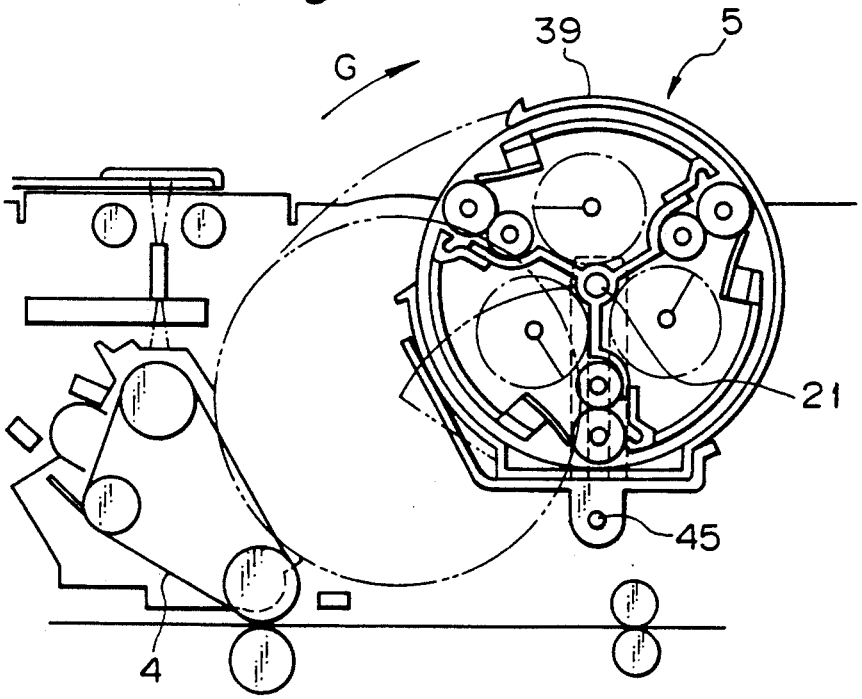
Figure 1C:
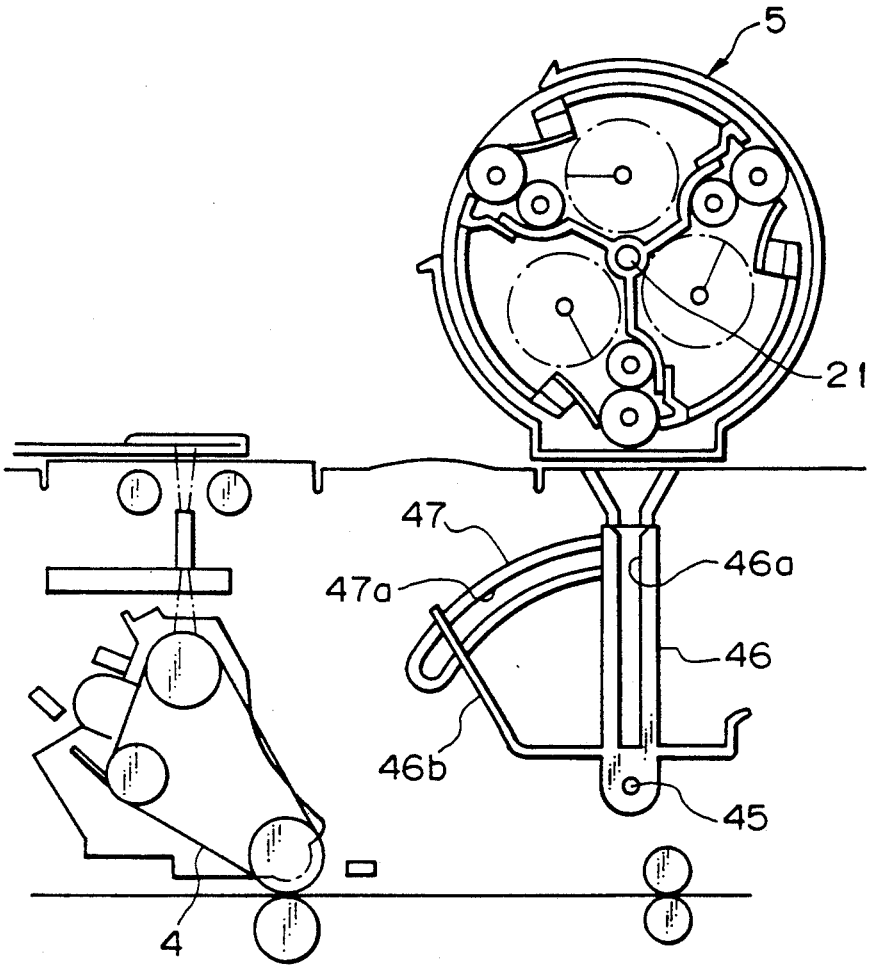

Referring to FIGS. 1A-1C, a mechanism for mounting and dismounting the revolver 5 will be described. As shown, a pivot shaft 45 is mounted on the copier body below the revolver 5 for allowing the revolver 5 to be angularly moved. An arm 46 is supported by the pivot shaft 45 at the lower end thereof to serve as a movable or rotatable member. A guide slit or engaging portion 46*a* is formed in the arm 46 and open at the upper end thereof for receiving the shaft 21 in the up-and-down direction. An auxiliary arm 46*b* is formed integrally with the arm 46 for holding part of the revolver 5. A guide member 47 is affixed to each of opposite side walls of the copier body and implemented as an arc whose center is located at the pivot shaft 45. A slit 47*a* is formed in the guide member 47 and capable of receiving the shaft 21. The slit 47*a* selectively guides the shaft 21 toward or away from the belt 4. The lowermost end of the slit 47*a* is located such that when the shaft 21 reaches it, the revolver 5 is positioned relative to the belt 4 and copier body and the weight of the revolver 5 acts on the guide member 47.

Assume that the revolver 5 should be removed from the copier body for a particular purpose, e.g., for replacing any of the developing units. Then, as shown in FIGS. 1B and 1C, the revolver 5 is rotated about the pivot shaft 45. At this instant, the shaft 21 is moved away from the developing position of the belt 4 (arrow G) along the slit 47*a* of the guide member 47 while being supported by the upper end of the guide slit 46. The shaft 21 is brought to a stop at a position substantially vertically above the pivot shaft 45. In this condition, the revolver 5 is removed from the copier body substantially vertically upward. The revolver 5 will be mounted on the copier body by a procedure opposite to the above-described procedure.

When the revolver 5 is mounted on the copier body, the shaft 21 is positioned by the lowermost end of the slit 47*a* of the guide member 47. While the weight of the revolver 5 suffices for the revolver 5 to be stably positioned, an auxiliary stop, not shown, may be used, if desired.

The revolver 5 which can be mounted and dismounted from the copier body as stated above has various advantages, as enumerated below.

(1) The revolver 5 with a plurality of developing units 9Y-9C can be easily mounted or dismounted by a single operation.

(2) The revolver 5 is simply moved toward or away from the belt 4 when mounted or dismounted. This protects the belt 4 and developing roller 22 from scratches or similar damage and eliminates the scattering of the toners without resorting to any complicated mechanism or operation.

(3) At the time of mounting and dismounting, the input gear 33 of the revolver 5 can be smoothly brought into and out of mesh with the drive gear 34 of the copier body. Hence, the gears are free from incomplete mesh, breakage, etc.

(4) The revolver 5 can be positioned by a simple construction and a minimum number of parts and, therefore, with accuracy.

(5) The revolver 5 is mounted and dismounted from the copier body in the up-and-down direction. This eliminates the need for slide rails and anti-fall guide nembers which would be necessary if the revolver 5 were mounted and dismounted at the front of the copier body. In addition, the revolver 5 can be positioned without resorting to a special member or operation.

Figure 10:
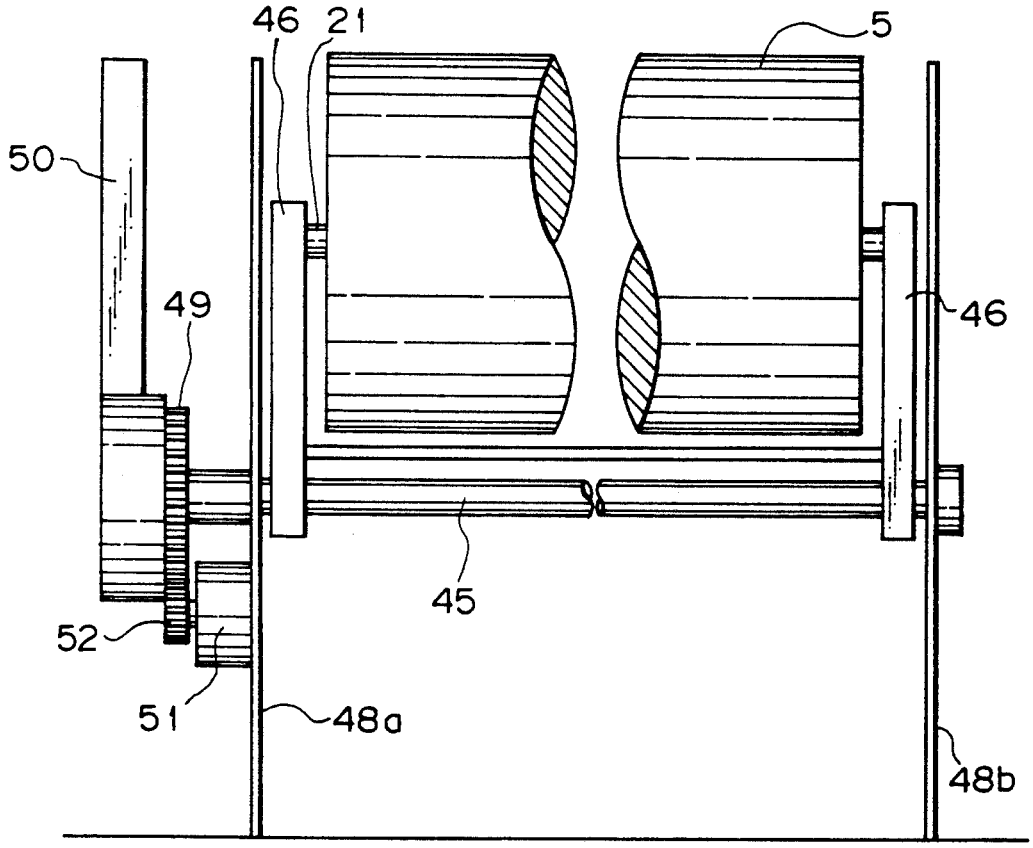
FIG. 10 is a side elevation showing an alternative embodiment of the present invention.
Figure 11:
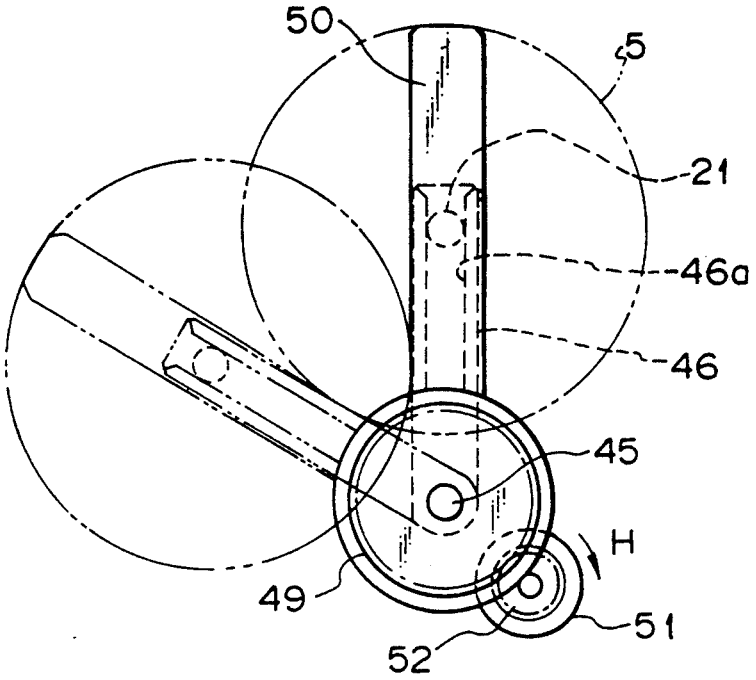
FIG. 11 is a fragmentary front view of the embodiment of FIG. 10.

A reference will be made to FIGS. 10 and 11 for describing an alternative embodiment of the present invention. In this embodiment, as well as other embodiments to follow, the same or similar constituents as or to the constituents of the previous embodiment are designated by the same reference numerals. As shown, the pivot shaft 45 for rotating the revolver 5 extends throughout a front and a rear side side wall 48*a* and 48*b* included in the copier body. The arms 46 are located inside of the side walls 48 and 48*b* and affixed to the pivot shaft 45 at the lower ends thereof. A gear 49 and a handle 50 are positioned in front of the front side wall 48*a* and affixed to the pivot shaft 45. A rotary oil damper 51 is mounted on the front end of the side wall 48*a*. A gear 52 is mounted on the damper shaft of the oil damper 51 and held in mesh with the gear 49. A one-way clutch, for example, is accommodated in the oil damper 51 such that a load acts on the damper 51 (a rotational force is absorbed) only in a direction H, FIG. 11.

The upper ends of the arms 46 are engaged with the shaft 21 of the revolver 5. Hence, when the handle 50 is rotated about the pivot shaft 45, the revolver 5 is moved toward or away from the belt 4. While the revolver 5 is moved into the copier body, the oil damper 51 regulates the rotational force although the weight of the revolver 5 acts. As a result, the revolver 5 is slowly brought to the end of the slit 47*a* of the guide member 47*a* and thereby positioned relative to the copier body and belt 4. When the revolver 5 is moved out of the copier body, a rotational force overcoming the weight of the revolver 5 is needed. In this case, the one-way mechanism of the oil damper 51 allows the revolver 5 to move away from the belt 4 without any excessive load acting thereon.

Figure 12A:
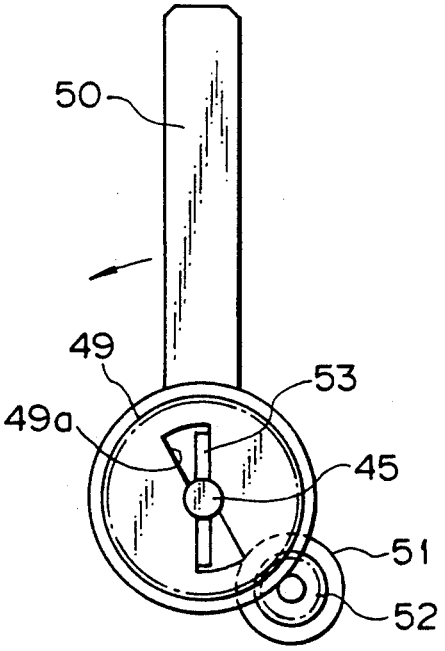
FIGS. 12A and 12B are fragmentary front views showing another alternative embodiment of the present invention.
Figure 12B:
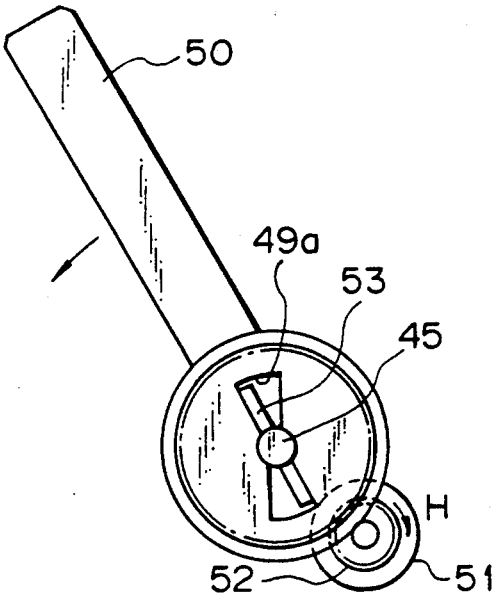

FIGS. 12A and 12B show another alternative embodiment of the present invention. As shown, the gear 49 is formed with a notch 49*a* having sectorial portions which are symmetric to each other with respect to the pivot shaft 45. A pin 53 is received in the notch 49*a* and extends throughout the pivot shaft 45 in a perpendicular relation. The operation timing of the pin 53 is regulated by the edges of the notch 49*a*. Specifically, when the handle 50 is rotated to mount the revolver 5 on the copier body, the pivot shaft 45 and arm 46 are rotated. As a result, the revolver 5 also starts moving along the guide member 47. However, the gear 49 does not rotate over the play between the pin 53 and the notch 49*a* of the gear 49 (about 30 degrees in the embodiment). As shown in FIG. 12B, when the pin 53 abuts against the edges of the notch 49*a*, the gear 52 also starts rotating with the result that the oil damper 51 starts acting. Specifically, when the handle 50 begins to be rotated for mounting the revolver 5, the oil damper 51 does not act; the damper 51 starts acting when the rotational force increases due to the weight of the revolver 5. This allows the revolver 5 to be easily and smoothly mounted on the copper body.

Figure 13:
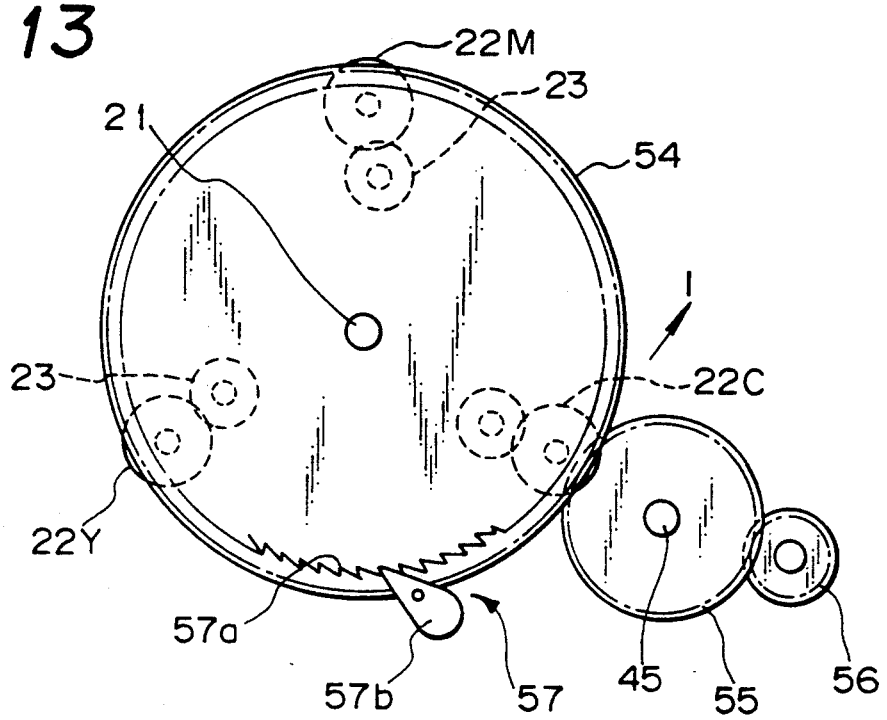
FIG. 13 is a fragmentary front view showing a further alternative embodiment of the present invention.

FIG. 13 shows a further alternative embodiment of the present invention, particularly a mechanism for replacing the color for development while the revolver 5 is mounted on the copier body. As shown, a gear (first gear) 54 is mounted on the gear 21 at the outside of the side wall 20*a* of the casing 20. An intermediate gear (second gear) 55 is mounted on and rotatable relative to the pivot shaft 45 and held in mesh with the gear 54.

Further, an input gear 56 is held in mesh with the intermediate gear 55 for transmitting the drive from the copier body. To replace the color for development, a drive mechanism, not shown, rotates the input gear 56 until the revolver 5 has been rotated a predetermined angular distance (e.g. 120 degrees) in the direction B. A locking member (restricting member) 57 is implemented as a ratchet mechanism made up of ratchet teeth 57*a* and a ratchet pawl 57*b* movable into and out of mesh with the teeth 57*a*. The locking member 57 allows the revolver 5 to rotate in the direction B relative to the cover 39, but prevents it from rotating in the opposite direction. Part of the arm 46 regulates the rotation of the cover 39 about the shaft 21.

In the above construction, to remove the revolver 5 from the copier body, the input gear 56 is reversed. Then, a rotational force acts between the intermediate gear 55 and the gear 54 in a direction I, causing the revolver 5 to automatically rotate in the removing direction. It is to be noted that when the color for development is replaced, the revolver 5 is rotated in the direction B opposite to the direction I and, therefore, prevented from rotating about the pivot shaft 45.

Figure 14:
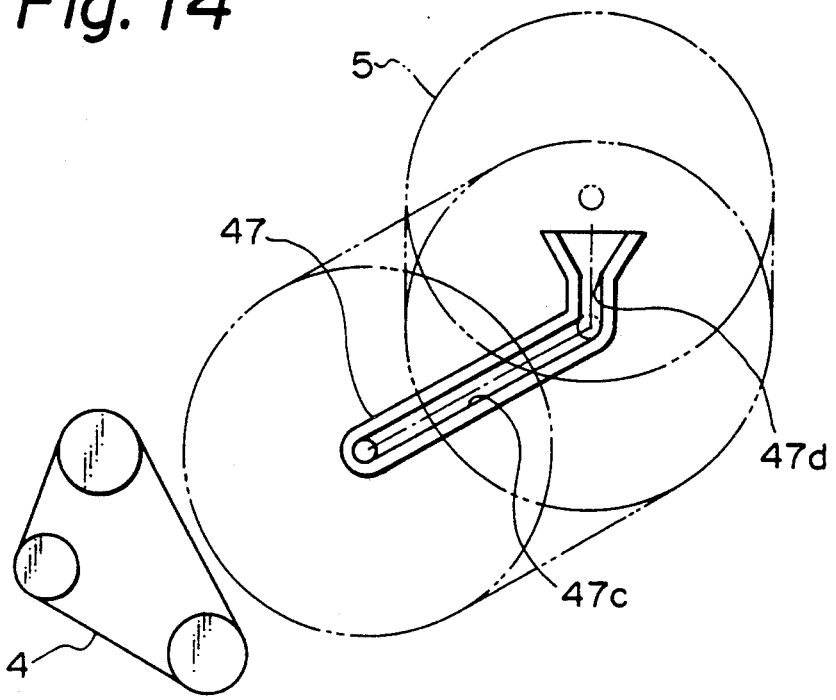
FIG. 14 is a front view showing a modified form of a guide member.

FIG. 14 shows a modified form of the guide member 47. As shown, the guide member 47 is formed with a linear slit 47*c* for guiding the revolver 5 obliquely (i.e. in a direction perpendicular to the belt 4). One end 47*d* of the slit 47*c* is open and flared upward to facilitate the ingress and egress of the shaft 21.

In summary, in accordance with the present invention, a revolver with a plurality of developing units can be easily mounted on or dismounted from an apparatus body by a single operation. The revolver is simply moved toward or away from a photoconductive element when mounted or dismounted. This protects the photoconductive element and developing rollers from scratches or similar damage and eliminates the scattering of toners without resorting to any complicated mechanism or operation. The revolver is mounted and dismounted from the apparatus body in the up-and-down direction. This eliminates the need for slide rails and anti-fall guide members which would be necessary if the revolver were mounted and dismounted at the front of the apparatus body. In addition, the revolver can be positioned without resorting to a special member or operation.

When the revolver is mounted on the apparatus body, it is positioned with a rotary shaft thereof engaged with the end of the slit of a guide member. Therefore, the revolver can be positioned by a simple construction and a minimum number of parts and, therefore, with accuracy. Especially, since the revolver exerts a pressure due to its own weight when the shaft is engaged with the end of the slit, it can be stably mounted on the apparatus body due to its weight only.

The revolver is mounted and dismounted from the outside of the apparatus. This makes it needless for the operator to insert his hand deep into the apparatus and, therefore, protects him from contamination ascribable to the toners as well as from injury due to the edges of parts.

The revolver is rotatable bout a pivot shaft and movable toward and away from the photoconductive element while being guided by a guide member. Hence, the total weight of the revolver is distributed to the guide member and the pivot shaft. This, coupled with the fact that the revolver is moved in an angular motion, promotes smooth and easy mounting and dismounting. Particularly, when an intermediate gear is provided coaxially with the pivot shaft, the distance between the axes of a drive gear mounted on the apparatus body and an input gear mounted on the revolver is maintained constant. As a result, the incomplete mesh and breakage of the gears, as well as vibration ascribable to them, are eliminated in the event of mounting and dismounting.

When the revolver is to be removed from the apparatus body, the input gear is reversed to generate a rotational force in a predetermined direction between the intermediate gear and the gear. This allows the revolver to automatically rotate in the removing direction and, therefore, further facilitates the removal of the revolver.

In addition, the rotation of the revolver about the shaft can be regulated by a ratchet mechanism or similar simple implementation, eliminating the need for a complicated rotation control mechanism. The apparatus is, therefore, inexpensive, small size, and light weight.

Various modifications will become possible for those skilled in the art after receiving the teachings of the present disclosure without departing from the scope thereof.

What is claimed is:

1. An image forming apparatus having an image carrier for electrostatically forming a latent image thereon, and a revolver type developing device located in close proximity to said image carrier and having a plurality of developing units each containing a powdery developer of particular color arranged around a rotary shaft, and rotating said developing device to selectively locate one of said developing units at a developing position where the developing unit faces said image carrier for developing the latent image, said apparatus comprising:

a guide member mounted on a body of said apparatus and formed with an engaging portion for guiding said developing device toward and away from said image carrier in engagement with said rotary shaft; and a movable member for holding said developing device in such a manner as to allow said developing device to be mounted and dismounted in an up-and-down direction and causing said developing device to move along said guide member.

2. An apparatus as claimed in claim 1, wherein said guide member positions said developing device relative to said body and said image carrier with said rotary shaft abutting against an end of said engaging portion.

3. An apparatus as claimed in claim 2, wherein said developing device exerts a pressure on said guide member due to gravity when said rotary shaft abuts against said end of said engaging portion.

4. An apparatus as claimed in claim 1, wherein said movable member is operated at the outside of a side wall of said body to move integrally with a pivot shaft mounted on said body.

5. An apparatus as claimed in claim 4, further comprising a handle positioned in front of a front side wall of said body and affixed to said pivot shaft.

6. An apparatus as claimed in claim 4, further comprising a first gear mounted on said rotary shaft, and a second gear rotatably mounted on said pivot shaft and directly or indirectly meshing with said first gear.

7. An apparatus as claimed in claim 6, further comprising a restricting member for restricting a rotation of said developing device about said rotary shaft when said developing device is moved in a dismounting direction.

8. An apparatus as claimed in claim 7, wherein when said developing device is moved in the dismounting direction, a driving force is transmitted to said second gear in a direction opposite to a direction in which said developing device is rotated for replacing said developing units.

* * * * *

UNITED STATES PATENT AND TRADEMARK OFFICE

CERTIFICATE OF CORRECTION

PATENT NO. : 5,258,819

DATED : November 2, 1993

INVENTOR(S) : Noriyuki Kimura et al.

It is certified that error appears in the above-indentified patent and that said Letters Patent is hereby corrected as shown below:

On the title page, Item [73],

The assignee should read: --Ricoh Company, Ltd., Tokyo, Japan--

Signed and Sealed this

Tenth Day of May, 1994

*Attest:*

Bruce Lehman

BRUCE LEHMAN

*Attesting Officer*

*Commissioner of Patents and Trademarks*